United States Patent [19]

Müller et al.

[11] Patent Number: 4,804,883

[45] Date of Patent: Feb. 14, 1989

[54] FRONT ATTACHMENT FOR CRT. E.G. FOR A MONITOR OR VIDEO TUBE

[75] Inventors: Dieter Müller, Gelsenkirchen; Wilhelm Rein, Fürth, both of Fed. Rep. of Germany

[73] Assignee: Flachglass Aktiengesellschaft, Furth, Fed. Rep. of Germany

[21] Appl. No.: 91,887

[22] Filed: Sep. 1, 1987

[30] Foreign Application Priority Data

Sep. 3, 1986 [DE] Fed. Rep. of Germany ..... 3629996

[51] Int. Cl.[4] ..... H01J 29/86; H01J 29/89

[52] U.S. Cl. ..... 313/478; 313/479; 313/474; 358/250; 358/252

[58] Field of Search ..... 313/478, 479, 480, 474, 313/112, 113, 116; 358/245, 247, 250, 252; 350/276 R, 276 SL

[56] References Cited

U.S. PATENT DOCUMENTS

| | | | |
|---|---|---|---|
| 2,734,142 | 2/1956 | Barnes | 313/478 |
| 3,708,622 | 2/1973 | Brown, Jr. et al. | 358/247 |
| 3,879,627 | 4/1975 | Robinder | 358/252 |
| 3,909,524 | 9/1975 | Ohkoshi et al. | 313/478 |
| 4,031,553 | 6/1977 | Sumiyoshi et al. | 358/247 |
| 4,663,562 | 5/1987 | Miller et al. | 313/478 |

FOREIGN PATENT DOCUMENTS 0119048 9/1984 European Pat. Off. .

*Primary Examiner*—David K. Moore
*Assistant Examiner*—Michael Horabik
*Attorney, Agent, or Firm*—Herbert Dubno

[57] ABSTRACT

Front attachment unit for the cathode ray tube of monitors, television sets or the like, consisting of a sheet of glass, in particular a sheet of gray glass, anti-reflection equipment on the front side and an absorption coating on the rear side, whereby the absorption coating has metallic atoms. The absorption coating is single-layer and made of chromium, a chromium/nickel alloy or silicides. It is anti-statically adjusted and grounded. It is of a thickness which reduces the light transmission compared with a non-coated sheet of glass by approximately a third.

10 Claims, 3 Drawing Sheets

FRONT ATTACHMENT FOR CRT. E.G. FOR A MONITOR OR VIDEO TUBE

FIELD OF THE INVENTION

Figure 1:
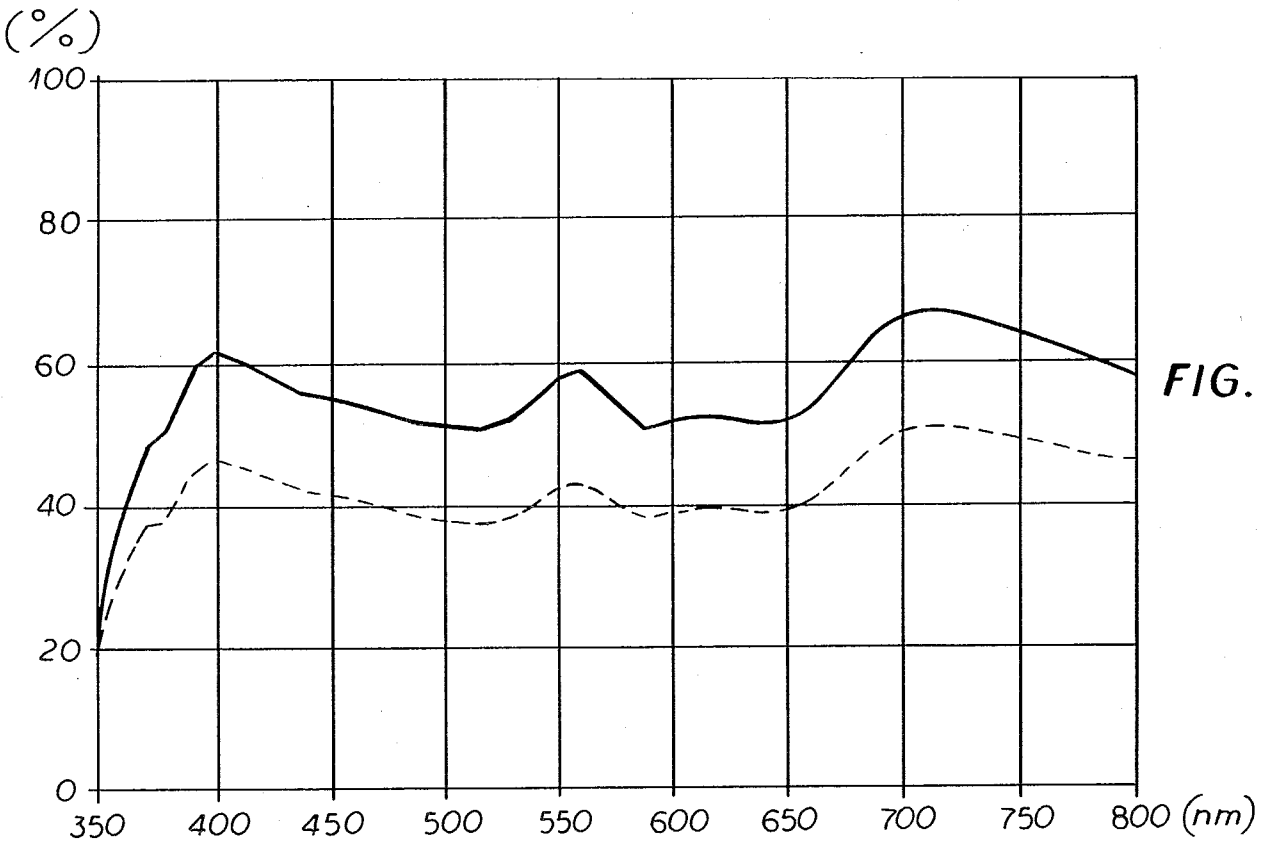

Our present invention relates to a front attachment unit for the cathode ray tube of monitors, television sets and the like, consisting of a glass sheet, in particular a grey glass sheet, an anti-reflection finish on the front side and an absorption coating on the rear side.

The anti-reflection finish on the front side can, for the most part, be of any type. It can for example be a multilayer coating made of substances such as $Al_2O_3$, $Ta_2O_5$, $SiO_2$, $SnO_2$, $TiO_2$, $CeF_3$, $ZrO_2$, $MgF_2$; it may be, for example, a double layer or a triple layer. The layers are alternately highly refractive and of low refractivity. It can however also, in particular in the case of bent glass sheets, be a fine etching of the glass surface on the front side. The term "sheet of glass" covers substrates made of inorganic glass, in particular of toughened safety glass, and of plastic. Such front units are placed in front of the so-called fluorescent screen of the cathode ray tube, which is also described as the "indicator board" in the case of monitors, and is joined with the latter.

BACKGROUND OF THE INVENTION

In the known front attachment unit of Europatent document No. EP 00 18 667, the absorption coating has two layers. It consists of a metallic layer, which can be made inter alia from chromium or from a chromium alloy, but does not have to be made of these materials, and of a dielectric layer. The metallic layer has a complex index of refraction, in which the quotient of an imaginary and a real part lies in a range between 0.7 and 3.0. The dielectric layer has an index of refraction in the range of 1.35 to 1.70. By means of this double layer absorption coating, so-called halation is suppressed, i.e. the contrast is improved.

It is known from German patent DE No. 23 30 898 that an absorption coating arranged in the manner described can have the effect of increasing contrast. In the known construction, however, the contrast effect and reduction of reflection remain in need of improvement.

OBJECT OF THE INVENTION

It is an object of the invention to provide a front attachment unit of the described structure with an improved contrast effect and to bring about a further reduction in reflection, with adequate resistance to corrosion.

SUMMARY OF THE INVENTION

In order to achieve this object, the invention provides that the absorption coating is a single layer and is made of chromium, a chromium/nickel alloy or silicides and is antistatically arranged and grounded and has a thickness which reduces the light transmission compared With the non-coated sheet of glass by approximately a third and generally between one quarter to four fifths.

In particular chromium and chromium-nickel silicide are preferred coatings. It is preferable to use chromium and up to 80% by weight of nickel in the silicide. If the absorption coatings are applied using the magnetron cathodic sputtering method, they are particularly resistant to scratching, which helps the resistance to corrosion.

Particularly good results are achieved if the absorption coating arrangement described is combined with special anti-reflection coatings, namely anti-reflection coatings made of the following three layers 1. $Al_2O_3$: Index of refraction $n=1.63$, optical thickness $n*d=\lambda/4$
2. $Ta_2O_5$: Index of refraction $n=2.1$, optical thickness $n*d=\lambda/2$
3. $MgF_2$: Index of refraction $n=1.38$, optical thickness $n*d=\lambda/4$ or of the following three coatings 1. $CeF_3$: Index of refraction $n=1.64$, optical thickness $n*d=\lambda/4$
2. $ZrO_2$: Index of refraction $n=2.05$, optical thickness $n*d=\lambda/2$
3. $MgF_2$: Index of refraction $n=1.36$, optical thickness $n*d=\lambda/4$ whereby the first coating is always applied directly to the sheet of glass and the others in succession on the previously applied coating. However, a double coating system can also be used, for example from the following system 1. $SnO_2$: Index of refraction $n=2.0$, optical thickness $n*d=2\lambda/23$
2. $SiO_2$: Index of refraction $n=1.5$, optical thickness $n*d=3\lambda/10$ The thickness is given in terms of a mean wavelength of about 550 nm.

The invention leads to astonishing effects: If the absorption coating made of the substances referred to has a thickness which reduces the light transmission compared with the non-coated sheet of glass (irrespective of the original degree of light transmission) by approximately a third, not only is the contrast effect improved, but at the same time the anti-reflection effect is improved.

Admittedly, the anti-reflection effect is basically determined by the anti-reflection coatings on the frontside; the anti-reflection effect which is achieved by combination with the absorption coating in accordance with the invention is however more effective and more color-neutral. Any ultraviolet rays which are intercepted are suppressed.

Interference, too, which in the known construction is based on static charging of the absorption coating, does not occur.

Where a monitor magnifying glass is used, good correlation between the monitor magnifying glass and the front attachment unit is possible.

By means of the conductive absorption coating on the rear side, a considerable reduction in the light transmission is achieved as well as the anti-reflection effect in the visible spectral range, so that considerably improved suppression of the light reflection occurring on the nondereflected screen surface is achieved.

The absorption coating on the rear side produces color-neutral de-reflection in the visible spectral range, because of the coating material and the layer thickness chosen, while affording adequate conductivity in order to divert any electrostatic charging by grounding of the absorption coating.

The dirtying of the surface of the screen caused by electrostatic charging and the associated reduction in image sharpness are thereby prevented. A further advantage is the protection of electronic components against static shock. The sheet of glass of the front attachment unit in accordance with the invention is also adequately resistant to corrosion with the normal environmental influences.

Preferably float clear glass or grey glass is used although machine made glass can also be used. For clear float glass the transmissivity should be reduced to about 60% of the transmissivity of the glass itself. In the case of grey float glass the transmissivity should be reduced to about 40% of the transmissivity of the glass itself. For machine made grey glass the reduction of transmissivity to 21% of the transmissivity of the glass itself is preferred.

BRIEF DESCRIPTION OF THE INVENTION

Figure 2:
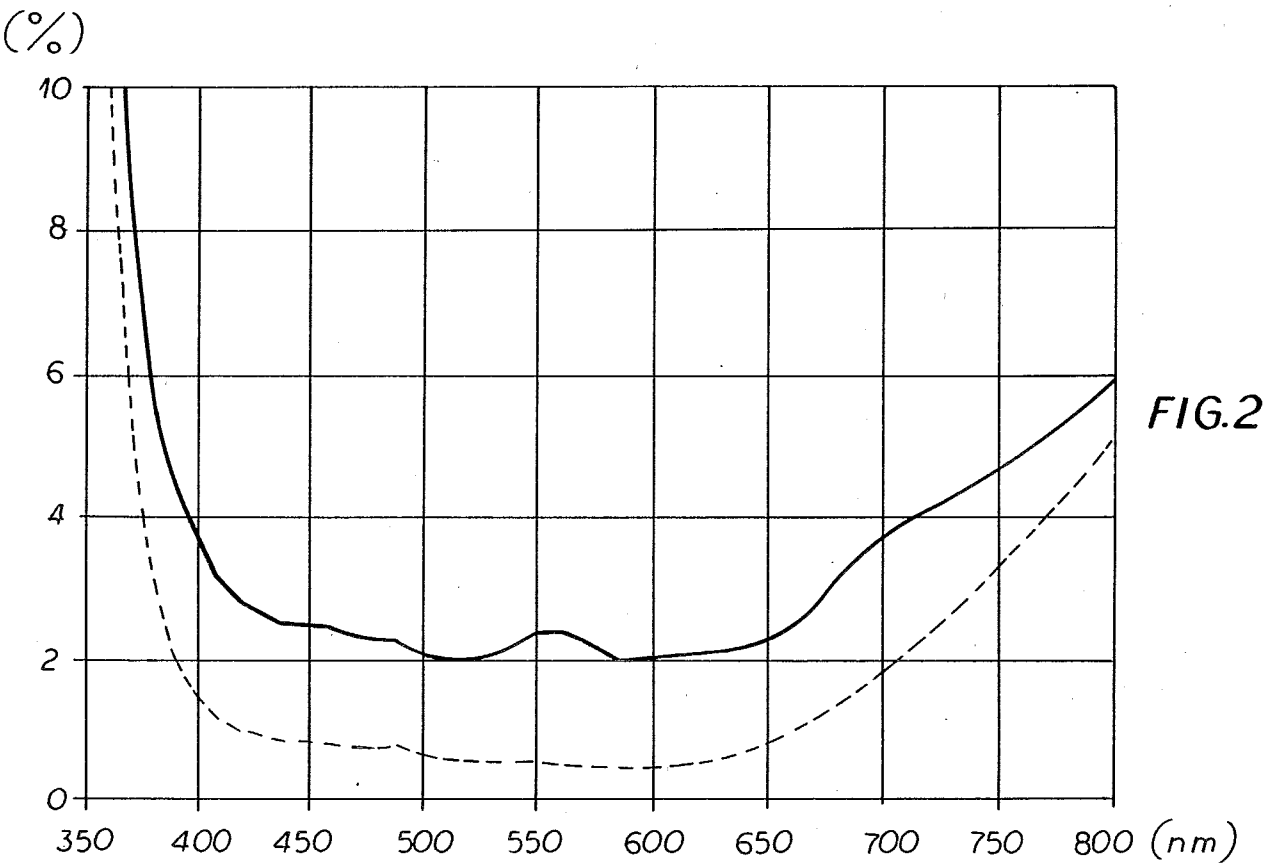
Figure 3:
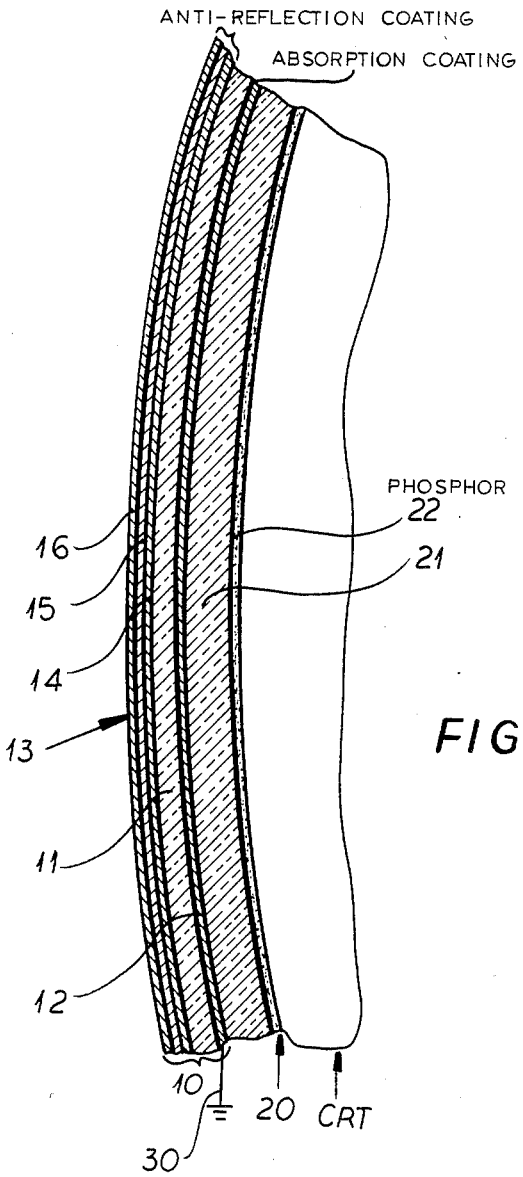

The above an other objects, features and advantages of the invention will become more readily apparent from the following description, reference being made to the accompanying drawing in which:

FIG. 1 and FIG. 2 are graphs illustrating optical characteristics of the front attachment of the invention, as described in the Specific Example; and FIG. 3 is a cross sectional view of the front attachment.

SPECIFIC DESCRIPTION

Referring first to FIG. 3, it can be seen that a cathode ray tube (CRT) 20 forming a monitor, a television imaging tube, an oscilloscope tube or the like, has a glass support 21 for a phosphor layer 22.

According to the invention, a front attachment 10 is applied to the face of this tube. The front attachment comprises a glass substrate 11 on a rear surface-of which is applied the partially light transmissive layer 12 of Cr, a Cr/Ni alloy or a silicide, especially a Cr silicide or a Cr/Ni silicide mixture which is conductive having a surface resistance of substantially 0.5–20 kilo ohms and is antistatic, being grounded at 30.

On the front surface of this attachment a multilayer anti-reflection coating is applied, e.g. with three coatings 14, 15 and 16 as has been described.

SPECIFIC EXAMPLE

In a high vacuum vaporization system, an anti-reflection coating was firstly applied onto a sheet of grey glass which was 3 mm thick and had 60% light transmission, with the coating consisting of a $\lambda/4$ layer $Al_2O_3$ with an index of refraction of $n=1.63$, a $\lambda/2$ layer $Ta_2O_5$ with an index of refraction of $n=2.1$ and finally a $\lambda/4$ layer $MgF_2$ with an index of refraction $n=1.38$.

The degree of transmission and the degree of reflection were then measured. The rear side of the glass was then coated in a magnetron cathodic sputtering system with an absorption coating made of Cr, so that the light transmission was reduced to 40% and conductivity was produced which could be classified with a surface resistance of 1 Kiloohm.

The degree of transmission and the degree of reflection were then again measured. FIG. 1 shows the degree of transmission (%), FIG. 2 the degree of reflection (%), in each case over the wavelength. The unbroken graph lines give the measured values of the glass sheet only provided with the anti-reflection coating, the dotted graph lines the measured values of the sheet of glass also provided with the absorption coating. The improvement achieved is obvious. In addition, there is a considerable improvement in the contrast effect.

We claim:

1. A front attachment for a cathode ray tube, comprising:

a single inorganic glass sheet integrally having a rear side adapted to be applied ahead of the face of a cathode ray tube and turned toward the cathode ray tube, and a front side facing away from the cathode ray tube;

an anti-reflection finish on said front side;

an electrically conductive anti-static light absorbent coating on said rear side in the form of a single layer selected from the group which consists of chromium, a chromium/nickel alloy and a metal silicide of a thickness applied by magnetron cathodic vapor deposition which reduces the light transmissivity by approximately one quarter to four fifths of the transmissivity of a sheet of the glass not provided with said coating; and means for grounding said light absorbent coating.

2. The front attachment defined in claim 1 wherein said light absorbent coating reduces the light transmissivity by approximately one third by comparison with a sheet of glass not provided with said coating.

3. The front attachment defined in claim 2 wherein said light absorbent coating has a surface resistance of substantially 0.5 to 20 kiloohms.

4. The front attachment defined in claim 3 wherein said light absorbent coating has a surface resistance of substantially 1 kiloohm.

5. The front attachment defined in claim 1 wherein the glass sheet is composed of clear float glass.

6. The front attachment defined in claim 5 wherein the light absorbent coating reduces the light transmissivity of the glass sheet composed of clear float glass to approximately 60% of its original light transmissivity.

7. The front attachment defined in claim 1 wherein the glass sheet is composed of gray float glass.

8. The front attachment defined in claim 7 wherein the light absorbent coating reduces the light transmissivity of the glass sheet composed of gray float glass to approximately 40% of its original light transmissivity.

9. The front attachment defined in claim 1 wherein said glass sheet is machine-made gray glass.

10. The front attachment defined in claim 9 wherein the light absorbent coating reduces the light transmissivity of the glass sheet composed of machine-made gray glass to approximately 21% of its original light transmissivity.

* * * * *